United States Patent [19]

Shindo et al.

[11] 3,934,398

[45] Jan. 27, 1976

[54] FALSE TWISTING SPINDLE

[75] Inventors: Noboru Shindo, Maikata; Hiroshi Hashizume, Kyoto, both of Japan

[73] Assignee: Murata Kikai Kabushiki Kaisha, Kyoto, Japan

[22] Filed: July 5, 1974

[21] Appl. No.: 486,194

[30] Foreign Application Priority Data

Aug. 13, 1973 Japan.....48-91100

[52] U.S. Cl...... 57/77.3; 57/77.45

[51] Int. Cl.[2]..... D01H 7/92

[58] Field of Search..... 57/77.3–77.45

[56] References Cited

UNITED STATES PATENTS

| | | | |
|---|---|---|---|
| 2,463,619 | 3/1949 | Künzle | 57/77.3 |
| 2,655,781 | 10/1953 | Heberlein et al. | 57/77.3 |
| 2,777,276 | 1/1957 | Klein | 57/77.3 |
| 3,475,895 | 11/1969 | Raschle | 57/77.3 |
| 3,759,025 | 9/1973 | Takai et al. | 57/77.3 |

*Primary Examiner*—Donald E. Watkins

*Attorney, Agent, or Firm*—Whittemore, Hulbert & Belknap

[57] ABSTRACT

False twisting device for producing crimped filamentary yarns by introducing the filament into a cylindrical hollow of a hollow spindle, winding it around a twisting pin mounted transversely in the cylindrical hollow and taking out the filament therefrom, wherein a center point of the minimum diameter portion of the twisting pin is displaced from a rotational center axis of the hollow spindle, both in the vertical and parallel directions as related to the axial line of the twisting pin respectively, so that the filament rotated together with the hollow spindle therein is positioned concentrically with the rotating center of the hollow spindle.

Said hollow spindle is mounted in a housing and supported by air bearings and it is rotated by applying compressed air to turbine blades which is provided on the circumference of the cylindrical hollow.

5 Claims, 5 Drawing Figures

FALSE TWISTING SPINDLE

BACKGROUND OF THE INVENTION

1. Field of the invention

The present invention relates to a false twisting device for producing crimped filamentary yarns, more particulary to a false twisting hollow spindle, provided with a turbin wheel, as a single body, and twisting pin laterally provided in the hollow space of the spindle. The hollow spindle is rotated by applying compressed air to the turbine wheel.

2. Description of the prior art

Generally, in a conventional false twisting device or apparatus, a twisting pin is laterally provided in center of a hollow of a false twisting spindle, so as to stabilize and/or balance the rotating motion of the hollow spindle. Due to the provision of the twisting pin, when the false twisting hollow spindle is rotated at a very high speed, undesirable yarn breakages frequently occur. That is, processing yarn fed into the hollow spindle is wound in one turn around the twisting pin and rotated, so that a portion of yarn entering the hollow of the spindle does not coincide with the rotating axis of the false twisting hollow spindle, but considerably deviates therefrom. Consequently, ballooning of the yarn caused by the centrifugal force of the spindle rotating at a very high speed, is accelerated and increased. Such generated yarn ballooning has little effect on yarn breakage while the hollow spindle is turning at a relatively slow speed, but, when the hollow spindle is driven at a very high speed, frequent yarn breakages do occur.

Referring to FIG. 1, which shows a basic type of the known false twisting device, yarn 2 supplied from a feed pin 1 is brought to a suitable tension by a pair of feed rollers 3, and a pair of delivery rollers 4. A yarn portion 2*a* of the yarn 2 entering a false twisting spindle 5, and disposed between the feed rollers 3 and the delivery rollers 4, is false twisted by the rotation of the false twisting spindle 5. After being thermally set the twists thereof are formed by a heater 6 sited between the feed rollers 3 and the false twisting spindle 5. Next, a yarn portion 2b of the yarn 2 which has passed through the false twisting spindle 5, and has been delivered from the delivery rollers 4, is wound on the yarn package 7. Ballooning is created in the yarn portion 2a entering into the false twisting spindle 5. However, ballooning is not created in the yarn portion 2*b* leaving from the false twisting spindle 5, because the yarn portion 2b is untwisted immediately after passing through the twisting pin provided in the hollow of the false twisting spindle 5. Further, the tension of the upstream yarn portion 2*a* on the twisting side becomes smaller than that of the downstream yarn portion 2b on the untwisted side by an amount corresponding to the contact resistance of the twisting pin 13.

FIG. 5 shows a cross-sectional view of a pressurized-air type false twisting spindle. A cylindrical hollow chamber 9 is formed at the central portion of the housing 8, and vertical hollow spindle 10 is supported by an upper and a lower bearing 11, 12 in concentric with the center line of the hollow chamber 9. A horizontal twisting pin 13 is provided in the hollow spindle 10 in such a position that the pin 13 traverses a vertical hollow 14 of the hollow spindle 10 in the diametric direction, and a turbine wheel 15 is secured to the outer peripheral surface of the hollow spindle 10 at the center portion.

The bearings 11, 12, which support the hollow spindle 10, have grooves 16, 17 formed on the outer peripheral surface of the hollow spindle 10. A pair of upper 0-rings 18, 19 and a pair of lower 0-rings 20, 21 are respectively provided at both tip end portions of the outer peripheral surface of the hollow spindle 10. A horizontal upper air duct 22 and a lower air duct 23 facing toward the vertical hollows spindle 10 are formed in the grooves 16, 17, respectively. The upper and lower bearing 11, 12 are rigidly secured to the outer periphery of the hollow chamber 9 of the housing 8 by the upper and lower 0-rings 18, 19 and 20, 21, respectively. The hollow spindle 10 is engaged with the housing 8 at positions facing the upper and lower end portions of the hollow chamber 9, and screwed with an upper and a lower nuts 24, 25, respectively, so that dropping of the hollow spindle 10 from the housing 8 never occurs. In FIG. 5, 26 is an inlet aperture for the compressed air for rotating the hollow spindle 10, 27 is an outlet aperture for exhausting air from the hollow spindle 10, while 28 indicates an inlet aperture of compressed air for the bearings 11, 12, and 29, 30 are branch tubes of the inlet aperture 28.

FIG. 2 shows a cross-sectional view of a conventional hollow spindle 10. In FIG. 2, a rotational axis 31 of the hollow spindle 10 and a center point 33 of the smallest diameter portion 32 of the twisting pin 13 coincide with each other. As stated before, the yarn portion 2*b* leaving the hollow spindle 10 has a greater tension than that of the yarn portion 2a entering the hollow, spindle 10, and therefore, the position of this yarn portion 2*b* coincides with the smallest diameter portion 32 of the twisting pin 13. On the other hand, the position of the yarn portion 2*a* on the false twisting side is displaced both in the parallel and vertical directions with reference to the axis of the twisting pin 13 by amounts equal to a diameter 2 of the yarn portion 2*a* and equal to 1 which is the sum of the radius of the smallest portion 32 of the twisting pin 13 and the radius of the yarn portion 2*a*, respectively. As a result, ballooning of the yarn portion 2*a* on the false twisting side is accelerated and/or magnified by rotation of the hollow spindle 10, so that various kinds of trouble arise. These are detailed as follows:

That is, 1. when the compressed air type false twisting spindle 10, of light weight (shown in FIG. 5), is driven at a very high speed, the spindle 10 vibrates and the bearing 11, 12 in the housing 8 contact the vibrating spindle 10, so that rapid wear of the bearings 11, 12 and/or the spindle 10 takes place.

2. In any type of false twisting spindle, whether of the compressed air driven type or frictional force driven type, twists of the ballooning yarn accumulate at a position adjacent to the twisting pin 13, so that propagation of the twists is prevented and, further, since the yarn which passes through the twisting pin 13 is in an insufficiently untwisted condition, the processed yarn produces continuously swelled untwisted portions;

3. The ballooned yarn contacts the inside wall of the hollow 14 of the spindle 10, so that the yarn is frequently broken and the yarn strength lowered.

Of the above-mentioned problems, the most difficult is the phenomenon of yarn breakages causes, and unless such problems are completely eliminated, it is impossible to carry out in practice, a false twisting operation by a false twisting spindle driven at speeds higher than 400,000 r.p.m.

SUMMARY OF THE INVENTION

Objects of the present invention are performed by specially defining a position of a twisting pin mounted in a false twisting hollow spindle. They will be described hereinafter.

That is, an object of the invention is to eliminate ballooning or vibration of filamentary yarns as a result of eccentricity thereof by introducing the filamentary yarns into the spindle without eccentricity.

Another object is to obtain high quality yarns by decreasing or eliminating yarn breakage and occurrence of untwisted yarn portions.

Further object is to eliminate early abrasion of a spindle bearing.

False twisting machines need an increased rotational speed of the false twisting spindle for a more rapid yarn processing operation. Various methods to meet these requirements have been proposed. In friction force drive type false twisting spindles and compressed air drive type false twisting spindles, many spindles capable of rotating at a very high speed (more than 400,000 r.p.m.) have come into use. However, in order to carry out a high speed operation of the spindle, there are various problems to be solved, though these are not problems at low speed operation of spindles. With the present invention, these problems are solved completely.

DESCRIPTION OF PREFERED EMBODIMENTS

Figure 1:
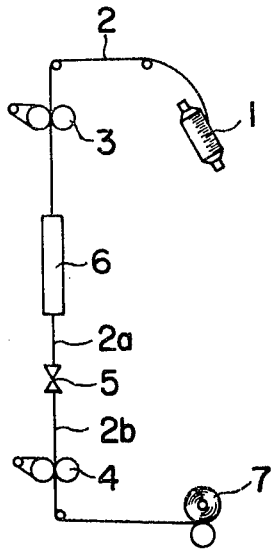
FIG. 1 is a schematic view of the false twisting apparatus.
Figure 2:
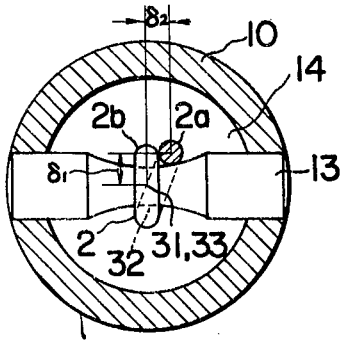
FIG. 2 PRIOR ART
FIG. 2 is a cross-sectional view of a conventional false twisting hollow spindle.
Figure 3:
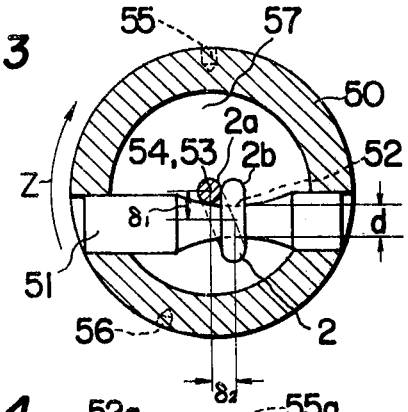
FIG. 3 is a cross-sectional view of a false twisting hollow spindle showing one embodiment of the present invention for carrying out Z-twist operation.
Figure 4:
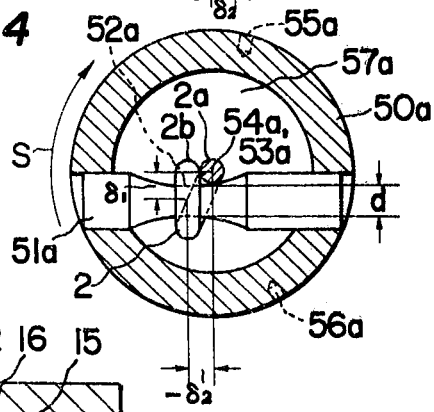
FIG. 4 is a same view as the FIG. 3 showing another embodiment of the present invention for carrying out S-twist operation.

Now referring to FIGS. 3, 4, embodiments of the present invention are explained. When filamentary yarn is subjected to the false twisting process, either a Z-twist method as shown in FIG. 3 of S-twist method as shown in FIG. 4 is applied to the processed yarn.

As shown in FIG. 3, twisting pin 51 is provided in the hollow spindle 50 for twist, in such a position that the center point of the minimum diameter portion 52 (this minimum diameter is represented by *d*) of the twisting pin 51 is displaced from the rotational center axis 54 of the hollow spindle 50, both in the directions vertical and parallel to the axial line of the pin 51 by distances $-\delta 1$ and $+\delta 2$, respectively. And, filamentary yarn 2*a* fed into the hollow spindle 50 is wound around the twisting pin 51 in a single turn in such a way that the yarn portion 2*b* of the yarn 2 leaving the hollow spindle 50 is positioned on the right hand side of the yarn portion 2*a* prior to entering the hollow spindle 50, as shown in FIG. 3. Consequently, a center 53 of the yarn portion 2 entering the hollow spindle 50 coincides with, or is positioned adjacent to, the rotational center axis 54 of the hollow spindle 50 when so required. As shown in FIG. 4, a twisting pin 51 *a* is provided in the hollow spindle 50*a* for effecting an S-twist in such a position that the center point of the minimum diameter portion 52*a* of the twisting pin 51*a* is displaced from the rotational center axis 54*a* of the hollow spindle 50*a*, both in the vertical and parallel directions as related to the axial line of the pin 51*a* by distances $\delta 1$ and $-\delta 2$, respectively. In FIGS. 3 and 4 $+\delta 2$ (or $-\delta 2$) represent the amount of displacement of the center of the minimum diameter portions 52, 52*a* of the twisting pinds 51, 51*a* in the right (or left) hand side direction from the rotational center axis 54, 54*a* of the hollow spindles 50, 50*a*, respectively. And, filamentary yarn 2 is wound around the twisting pin 51*a* in a single turn in such a way that the yarn portion 2*b* leaving the hollow spindle 50*a* is positioned on the left hand side of the yarn portion 2*a* that enters the hollow spindle 50*a*, as shown in FIG. 4. Consequently, the center 53*a* of the yarn portion 2*a* entering the hollow spindle 50*a* can be made to coincide with, or can be positioned adjacent to, the rotational center axis 54*a* of the hollow spindle 50*a*. Reference FIGS. 55 and 56 in FIG. 3 or 55*a* and 56*a* in FIG. 4, are a pair of balancing recesses for eliminating any unbalance of the hollow spindle 50 or 50*a*, created due to displacement of twisting pins 51 or 51*a*. However, it is of course possible to maintain this balance by eliminating the axial end portions.

Figure 5:
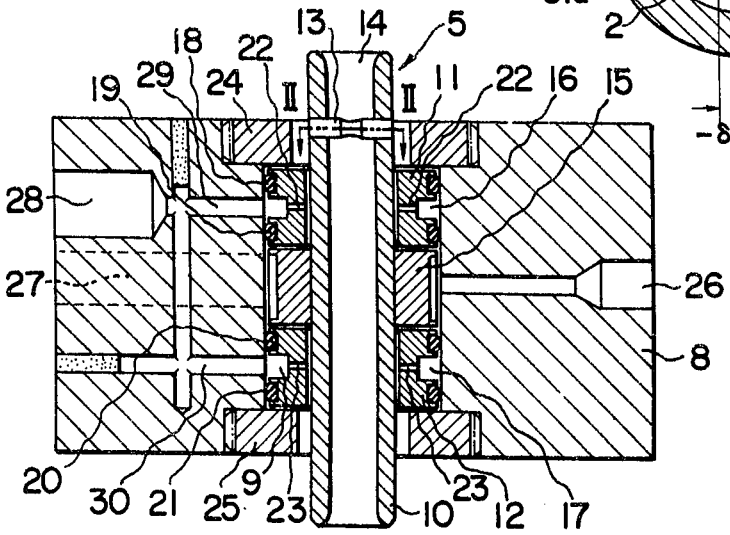
FIG. 5 is a cross-sectional plan view showing a compressedair driven type spindle.

The hollow spindle 50 shown in FIG. 3 or 50*a* shown in FIG. 4 of the present invention, is provided with turbine blades (not shown) similar to the conventional embodiment as shown in FIG. 5 besides the twisting pins 51 or 51*a* and hollow spindle 50 or 50*a* and the spindle is driven by air jet stream applied to the turbine blades. Further, the hollow spindle 50 or 50*a* can be supported in housing 8 by support mechanisms (not shown) similar to conventional bearings 11, 12, as shown in FIG. 5. Next, the operation of the false twisting device according to the means of the present invention where the hollow spindle 50, or 50*a* is supported in the housing 8 will be explained with reference to FIG. 5. As shown in FIG. 5, after the yarn 2 is wound about the twisting pin 51 or 51*a* provided in the hollow 57 or 57*a* of the hollow spindle 50 or 50*a*, an air jet stream is supplied from the air inlet aperture 28, for bearings 11, 12 forcing air into the hollow 57 or 57*a* via the upper and lower branch tubes 29, 30 and the upper and lower air ducts 22, 23, respectively, while another air jet stream is forced from the air inlet aperture 26 for rotating the spindle 10 providing the turbine blades 15. Then the bearings 11, 12 and the hollow spindle 50 or 50*a* commence rotation while always maintaining a small space between them. Next, a part of the air jet stream from the lower air duct 23 passes through the space between the hollow spindle 50 or 50*a* and the lower bearing 12, and impacts on the lower surface of the turbine blade 15. Similarly, a part of the air jet stream from the upper air duct 22 passes through a space between the hollow spindle 50 or 50*a* and the upper bearing 11, and impacts on the upper surface of the turbine blade 15. Consequently, the hollow spindle 50 or 50*a* is driven in a floating condition in the hollow chamber 9 while balanced by both jet air streams. That is, the hollow spindle 50 or 50*a* turns while moving up and down along a clearance defined by the difference in distance between the lower surface of the upper bearing 11 and the upper surface of the lower bearing 12, and the distance between upper and lower surfaces of the turbine wheel 15. Where clearance is small, the rotating spindle 50 or 50*a* comes into contact with the bearings 11 and 12 and, therefore, the driving speed of the spindle 50 or 50*a* is lowered. If the center 53 or 53*a* of the yarn 2*a* introduced into the hollow 57 or 57*a* of the spindle 50 or 50*a* is positioned either coincident with, or adjacent to, the rotational center axis 54 or 54*a* of the spindle 50 or 50*a*, respectively, undesirable ballooning or vibration of the yarn 2*a* will not be occured. However, in practice, it is almost impossible to retain this preferred positional relationship between the center 53 or 53*a* of the yarn 2*a* on the twisting side and the rotational center axis 54 or 54*a* of the hollow spindle 50 or 50 *a*, due to a lack in processing precision and the vibration of yarn 2*a*.

The following table shows rates of yarn breakages (number of yarn breakages in 200 spindles per hour) obtained by experiment. In the experiment, a twisting pin having a minimum diameter $d = 600\ \mu$ was used, and polyester yarns of 20, 150 and 300-deniers were processed by a false twisting spindle at rotational speeds of 1,530,000, 750,000 and 450,000 r.p.m., respectively.

(A)

20-deniers, 1,530,000 r.p.m.

| | | | | | | | | | | | |
|---|---|---|---|---|---|---|---|---|---|---|---|
| δ1 | 530 | 480 | 430 | 380 | 350 | 330 | 310 | 280 | 230 | 180 | 130 |
| δ2 | 260 | 210 | 160 | 110 | 80 | 60 | 40 | 10 | −40 | −90 | −140 |
| Number of yarn breakages | 1.0 | 0.8 | 0.5 | 0.5 | 0.5 | 0.3 | 0.5 | 0.5 | 0.5 | 0.8 | 1.0 |

(B)

150-deniers, 750.000 r.p.m.

| | | | | | | | | | | | |
|---|---|---|---|---|---|---|---|---|---|---|---|
| δ1 | 580 | 530 | 480 | 430 | 400 | 380 | 360 | 330 | 280 | 230 | 180 |
| δ2 | 360 | 310 | 260 | 210 | 180 | 160 | 140 | 110 | 60 | 10 | −40 |
| Number of yarn breakages | 1.0 | 0.8 | 0.6 | 0.5 | 0.5 | 0.3 | 0.5 | 0.5 | 0.6 | 0.8 | 1.0 |

(C)

300-deniers, 450,000 r.p.m.

| | | | | | | | | | | | |
|---|---|---|---|---|---|---|---|---|---|---|---|
| δ1 | 610 | 560 | 510 | 460 | 430 | 410 | 390 | 360 | 310 | 260 | 210 |
| δ2 | 420 | 370 | 320 | 270 | 240 | 220 | 200 | 170 | 120 | 70 | 20 |
| Number of yarn breakages | 1.0 | 0.8 | 0.8 | 0.5 | 0.5 | 0.3 | 0.5 | 0.5 | 0.8 | 0.8 | 1.0 |

As is apparent from the above table, by suitable selection of the values of δ1 and δ2 so as to position the center of the yarn introduced into the spindle close to the rotational center axis of the spindle, occurrence of yarn breakages can be virtually eliminated.

What is claimed is:

1. False twisting device for producing crimped filamentary yarns comprising a hollow cylindrical spindle having an axis of generation, means mounting the hollow cylindrical spindle for rotation about the axis of generation thereof, a twisting pin secured in the hollow cylindrical spindle and extending thereacross transversely of the axis of generation of the hollow cylindrical spindle having a minimum diameter portion with a center point, the center point of which is displaced transversely of the axis of generation of the hollow spindle in two mutually perpendicular directions distances $\delta_1$ and $\delta_2$ respectively.

2. Structure as set forth in claim 1, wherein the minimum diameter of the twisting pin is equal to a distance $d$ and the distance $\delta_1$ is related to the distance $d$ and yarn size by the formula $$d/2 - 120\ \mu \leq \delta_1 \leq d/2 + 260\mu.$$

3. Structure as set forth in claim 1, wherein the distance $\delta_2$ is related to the yarn size by the formula $$-90\mu \leq \delta_2 \leq 370\mu.$$

4. Structure as set forth in claim 1 wherein the means mounting the hollow cylindrical spindle includes a body member, an opening through the body member, air bearings positioned within the opening through the body member receiving the hollow cylindrical spindle, means securing the air bearings within the opening through the body member and means for providing air under pressure to the air bearings.

5. Structure as set forth in claim 4, and further including turbine blades secured to the hollow cylindrical spindle centrally thereof between the air bearings, and means applying air under pressure to the turbine blades through the body member.

* * * * *